United States Patent [19]

Hatuse et al.

[11] 4,257,115

[45] Mar. 17, 1981

[54] SWITCH STRUCTURE FOR ELECTRONIC TIMEPIECE

[75] Inventors: Toshikazu Hatuse, Tanashi; Minoru Natori, Tokyo; Toshikazu Shimazaki, Tanashi; Kouhei Kawanobe, Kawagoe; Hiroshi Ogawa, Tokorozawa, all of Japan

[73] Assignee: Citizen Watch Co., Ltd., Tokyo, Japan

[21] Appl. No.: 876,733

[22] Filed: Feb. 10, 1978

[30] Foreign Application Priority Data

Feb. 12, 1977 [JP] Japan ..... 52/14369
Mar. 7, 1977 [JP] Japan ..... 52/23885

[51] Int. Cl.[3] ..... G04C 17/00; G04B 23/02; G04B 19/04

[52] U.S. Cl. ..... 368/69; 368/74; 368/80; 368/82; 368/232; 368/251

[58] Field of Search ..... 58/23 R, 50 R, 57.5, 58/85.5, 152 R, 152 B, 127 R, 127 B; 200/DIG. 1; 340/324 R, 324 M, 712

[56] References Cited

U.S. PATENT DOCUMENTS

| | | | |
|---|---|---|---|
| 3,757,322 | 9/1973 | Barkan | 200/DIG. 1 |
| 3,813,533 | 5/1974 | Cone | 58/50 R |
| 3,945,191 | 3/1976 | van Berkum | 58/50 R |
| 4,017,848 | 4/1977 | Tannas | 340/324 M |
| 4,055,755 | 10/1977 | Nakamura | 58/152 R |
| 4,077,032 | 2/1978 | Volkman | 58/50 R |
| 4,091,610 | 5/1978 | Sasaki | 200/DIG. 1 |
| 4,120,036 | 10/1978 | Maeda | 58/152 R |

*Primary Examiner*—Vit W. Miska

[57] ABSTRACT

A switch structure for an analog quartz crystal timepiece having a watchglass plate, a time dial to display time in an analog mode, and a digital display device, which switch structure comprises a plurality of transparent electrically conductive electrode films provided on the watchglass plate at positions corresponding to numerical display indicia on the time dial to permit generation of input signals corresponding to the numerical display indicia, respectively.

2 Claims, 8 Drawing Figures

SWITCH STRUCTURE FOR ELECTRONIC TIMEPIECE

FIELD OF INVENTION

This invention relates to quartz crystal electronic timepiece and, more particularly, to a quartz crystal electronic wristwatch including a touch sensitive electrode switch structure.

BACKGROUND OF THE INVENTION

Timepieces which incorporate alarm means and make use of digital or analog displays have been marketed for a number of years. Those which employ the analog system rely upon mechanical means and set alarm time by an alarm mechanism which is linked to an hour wheel. In recent years, electronic technology and miniaturization of electronic components have progressed to the point where electronic timepieces with digital alarm systems are now widely available. These new alarm systems are much more precise than the conventional mechanical variety but possess shortcomings in terms of operability, and setting the alarm time is particularly difficult. On the other hand, conventional wristwatches equipped with calculators have heretofore made use of electro-optical display means such as liquid crystals or light emitting diodes to display time and the results of calculations. In such wristwatches it is necessary to provide a separate display section for the calculator function so that the time read-out can be displayed in a continuous fashion, and the timepiece is equipped with an input section operated by mechanical switches. Both of these features are disadvantageous since they result in a complicated mechanism and larger timepiece size.

SUMMARY OF THE INVENTION

It is, therefore, an object of the present invention to provide an electronic wristwatch having a simple switch structure to permit various controls in the wristwatch. It is another object of the present invention to provide an electronic wristwatch having a touch sensitive electrode switch structure.

It is another object of the present invention to provide an electronic wristwatch having a touch sensitive electrode switch structure including a plurality of transparent electrically conductive electrode films formed on the surface of a watch glass plate at positions corresponding to numerical indicia on a time dial for thereby permitting generation of an input signal having a numeric value equal to the corresponding numerical indicia of the time dial.

BRIEF DESCRIPTION OF DRAWING

These and other objects, features and advantages of the present invention will become more apparent from the following description when taken in conjunction with the accompanying drawings, in which.

DESCRIPTION OF PREFERRED EMBODIMENTS

Figure 1:
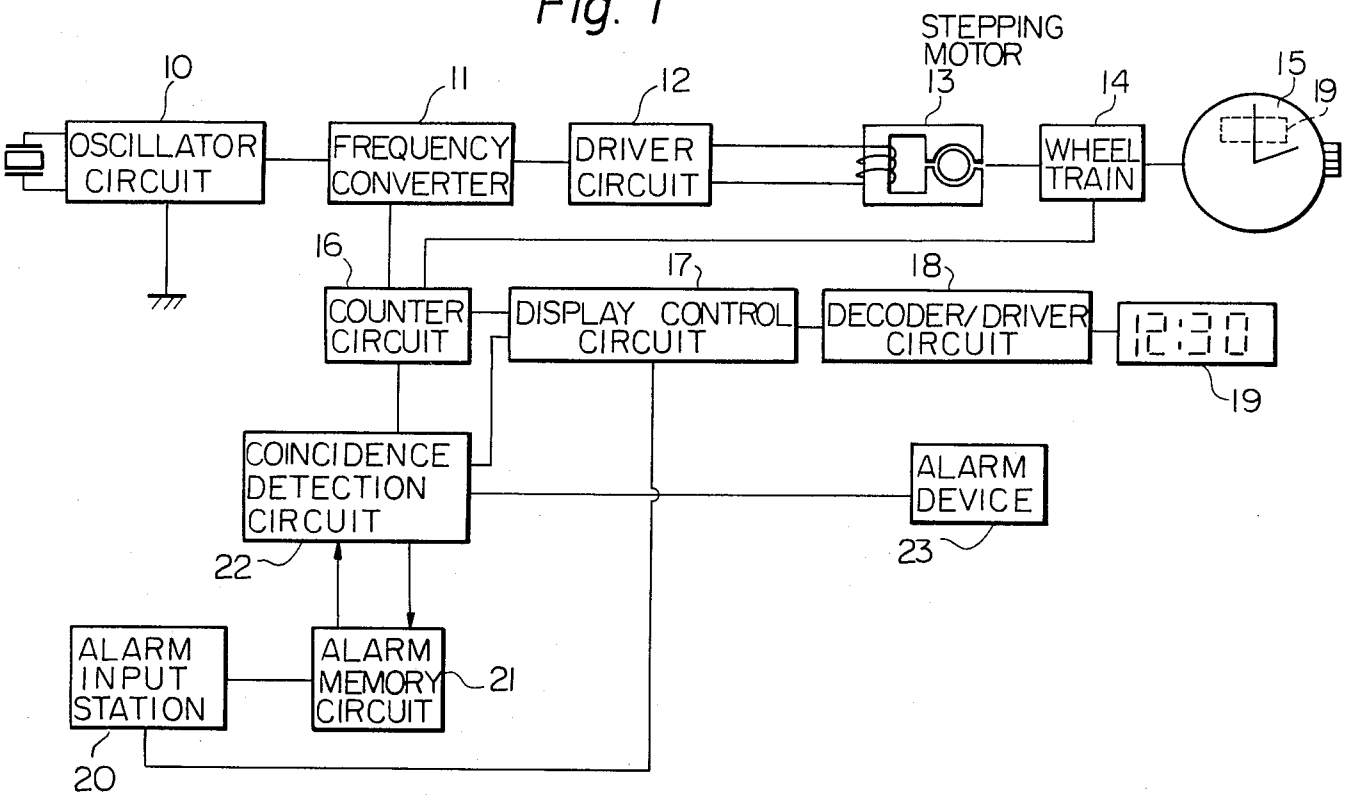
FIG. 1 is a block wiring diagram of an electronic timepiece having a switch structure according to the present invention.

FIG. 1 shows an example of a block wiring diagram showing an alarm-equipped timepiece incorporating a switch structure according to the present invention. The timepiece is shown as comprising a timekeeping system which includes a crystal-controlled oscillator circuit 10, a frequency converter 11, a driver circuit 12, an electro-mechanical transducer such as a stepping motor 13, a wheel train 14 and an analog display section 15, and a digital alarm system which includes a counter circuit 16, a display control circuit 17, a decoder/driver 18, a digital display device 19, an alarm imput station 20, an alarm memory circuit 21, a coincidence detection circuit 22, and an acoustic alarm device 23. The timepiece is arranged such that coincidence between the current time in the timekeeping system and the count of the alarm system is determined by a signal obtained from a portion of the wheel train 14. Alarm time which is set by alarm input station 20 is stored in the alarm memory circuit 21, and the coincidence detection circuit 22 detects coincidence between the time indicated by the analog timekeeping system and that stored in the memory circuit 21. Upon detection of such coincidence, the alarm device emits a suitable acoustic sound for a prescribed period.

Figure 2:
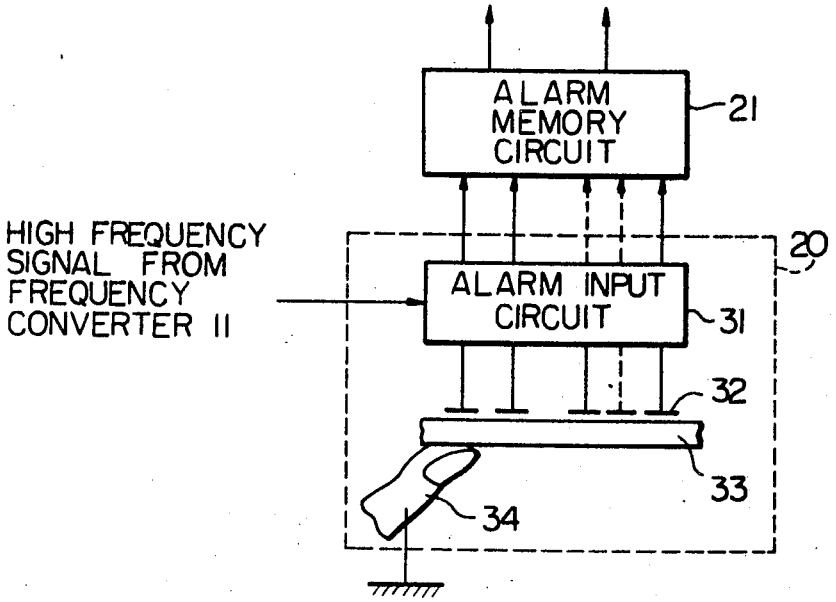
FIG. 2 is a detailed block diagram of a part of the timepiece shown in FIG. 1.

FIG. 2 is useful in explaining the alarm input station 20. A plurality of transparent electrically conductive films 32 are formed on a watchglass plate 33. Bringing any part of the body, such as a finger 34, to be close to the film 32 gives rise to a capacitance between the finger and the film. This permits a high frequency signal through an alarm input circuit 31, thereby making it possible to set alarm time data into alarm memory circuit 21. The alarm input circuit and alarm memory circuit do not constitute the present invention and, therefore, a detailed description of these components is herein omitted.

Figure 3:
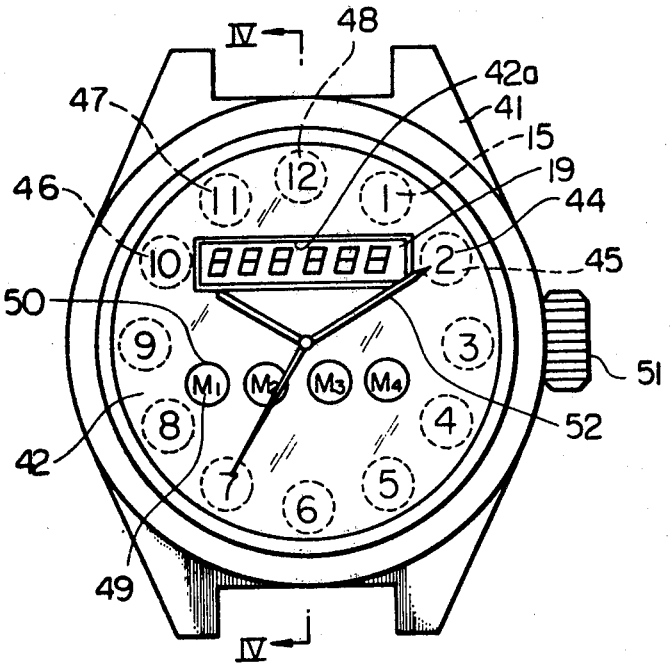
FIG. 3 is a plan view of the timepiece shown in FIG. 1.
Figure 4:
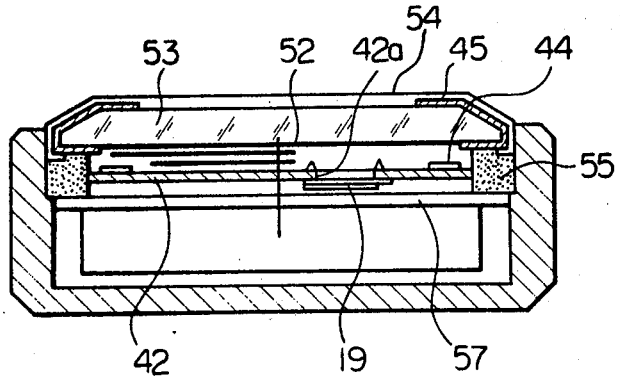
FIG. 4 is a cross sectional view taken on line IV—IV of FIG. 3.

FIGS. 3 and 4 are respective front and cross-sectional views of the timepiece shown in FIG. 1. The timepiece includes the electro-optical display section 19 such as a liquid crystal cell or an electrochromic material mounted on lower surface of the watch dial 42 having an access window 42*a*, and is constructed so as to display alarm time through the window 42*a*. A plurality of transparent electrically conductive film electrodes 45 are formed on watchglass plate 53 at positions corresponding to numerals 44, each of which from 1 to 9 represent corresponding input time information, while electrode 46, or numeral 10, corresponds to 0. Electrodes 47, 48, or numerals 11 and 12, serve to effect writing in of hours and minutes information, respectively. For example, to set the alarm to 7:30, electrically conductive film electrodes corresponding to time-indicating numerals 7, 11, 3, 10 and 12 are touched in the order given, and memory switch 50 is touched to store 7:30 as first alarm time data $M_1$ in the 1st memory alarm memory circuit 21, as illustrated in FIG. 1.

In the present embodiment, a 24-hour display is adopted for the alarm function. However, if the timepiece is adapted so that an AM and PM signal can be obtained from wheel train 14, a 12-hour display can be adopted.

The arrangement described above allows the time to be read without difficulty in an ordinary analog fashion by means of hands 52 since the electrically conductive film electrode 45 formed on the watchglass plate 53 is transparent. The arrangement thus does not detract from the analog display function of the timepiece.

Each segment of film 45 is disposed down the side surface of watchglass plate 53 and is connected to the alarm input circuit 31, as shown in FIG. 2, by means of electrically conductive connectors 55 and circuit board 57 which can be seen in FIG. 4. A transparent insulating film 54 includes the transparent electrically conductive film 45 and is formed over the entire surface of watchglass plate 53 with a protective film interposed therebetween.

According to the input section constructed as described above, alarm time data can be memorized in turn through the alarm input circuit, thereby providing a convenient, easily operable electronic timepiece equipped with an alarm. Moreover, although not depicted in the drawings, the electro-optical display section 19 can be adapted to digitally display calendar information, such as year, month, date and day of the week information when the alarm is not in use.

Although the transparent electrically conductive film in the present embodiment is provided on the upper surface of the glass plate, the same effect can be obtained by providing the same on the lower surface (the side facing the dial) of the watchglass. Further, information can be written into the memory circuit using a simple electrically conductive probe instead of a finger.

In accordance with the input section of the present invention as described above, a switch is constructed by disposing a plurality of transparent electrically conductive film electrodes so as to correspond to numerals, characters or symbols provided on a watch dial, whereby it is possible to provide a thin, compact alarm-equipped electronic timepiece having the same size and design as an ordinary timepiece, and at the same time eliminate the conventional complicated mechanical switches and replace them with switches of an electrical type, an advantage which permits simplification of the timepiece case and enhancement of its water-proof property.

Figure 5:
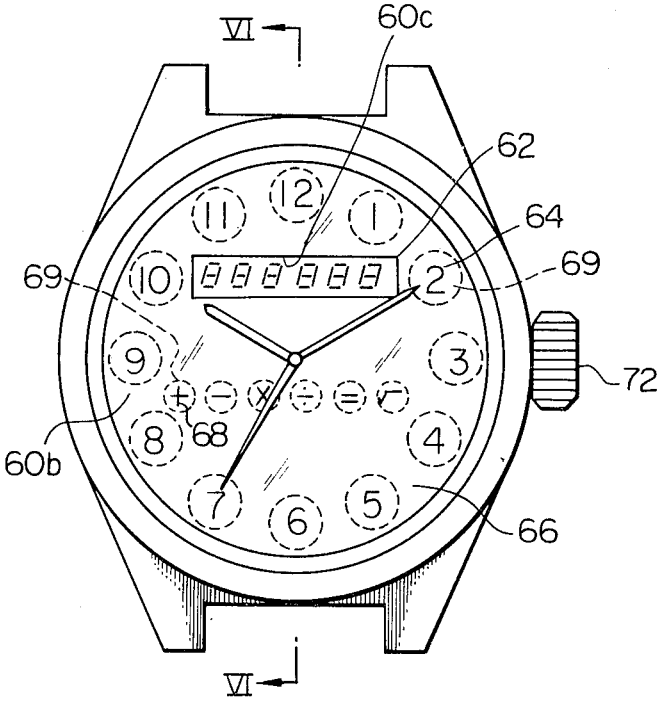
FIG. 5 is a plan view showing another preferred embodiment of a switch structure incorporated in an electronic calculator timepiece.
Figure 6:
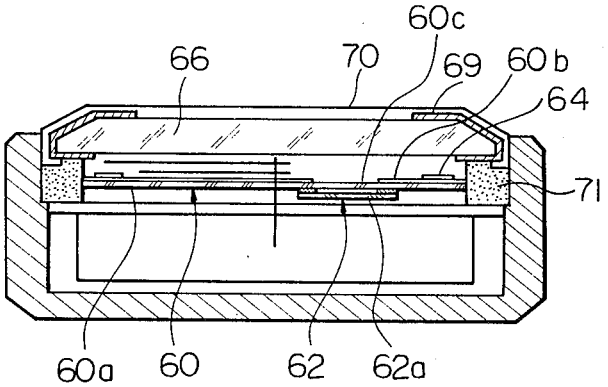
FIG. 6 is a cross section taken on line VI—VI of FIG. 5.

FIGS. 5 and 6 show another preferred embodiment of a touch switch structure according to the present invention, the touch switch structure being shown as incorporated in an electronic timepiece equipped with an electronic calculation circuit. In this illustrated embodiment, a time dial 60 comprises a transparent glass plate 60*a*, a shielding layer 60*b* formed on the glass plate 60*a* over an entire surface of the glass plate 60*a* except an opening or display area 60*c* of an electro-optical display device 62, and a plurality of equally spaced time-indicating display numerals 64 provided on the shielding layer 60*b*. The display device 62 may comprise a liquid crystal display cell 62 including an upper glass plate composed of the glass plate 60*a* of the time dial, a lower glass 62*a*, and a liquid crystal material filled therebetween. A plurality of transparent electrically conductive film electrodes 68 are formed on a watch glass plate 66 and serve as function switch keys to perform various functions desired for effecting calculating function of the calculation circuit.

Figure 7:
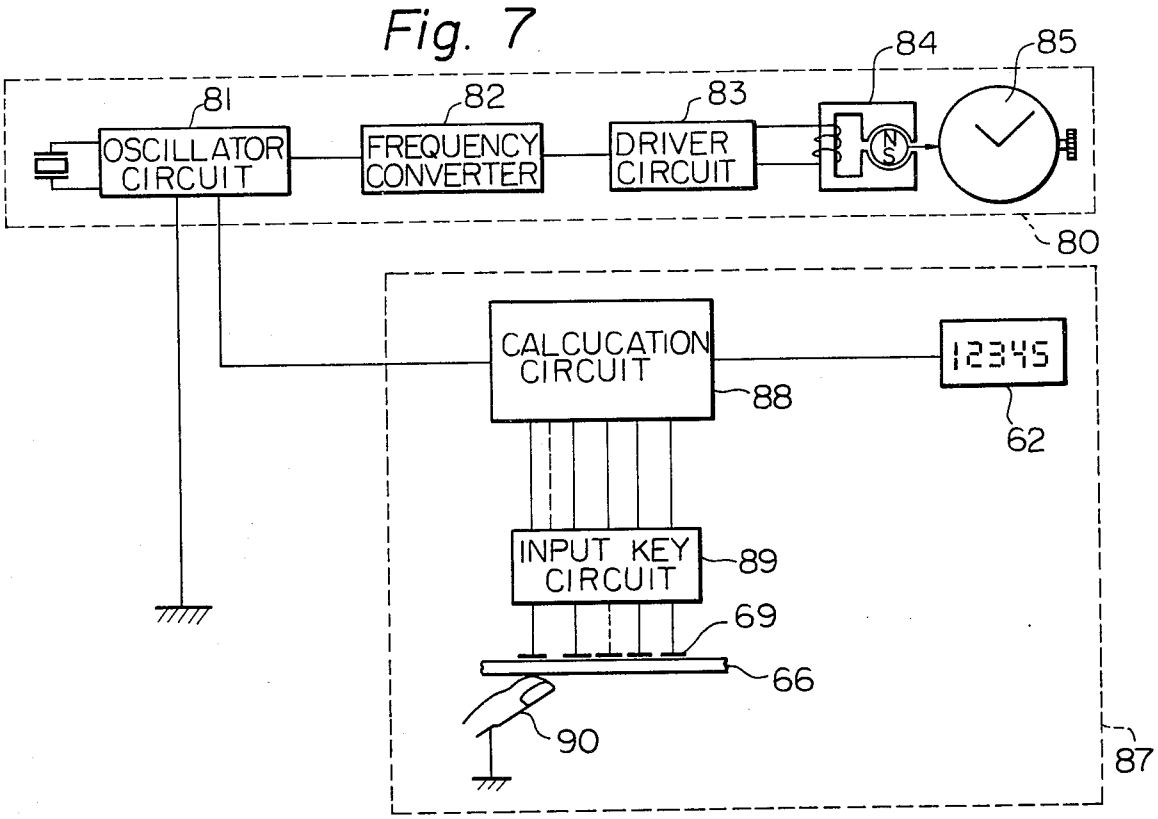
FIG. 7 is a block wiring diagram of the timepiece shown in FIG. 5.

FIG. 7 is a block wiring diagram showing the structure of the timepiece shown in FIG. 5. The timepiece comprises a timekeeping block 80 which includes a crystal controlled oscillator circuit 81, a frequency converter 82, a driver circuit 83, an electro-mechanical transducer 84, and an analog display section 85, and a calculator block 87 which includes a calculation circuit 88, an input key circuit 89, a plurality of transparent electrically conductive film electrodes 69, watchglass 66, a transparent insulating film 70, and calculator function display section 62.

In FIGS. 5, 6 and 7, the transparent electrically conductive films 69 which allow numerals to be written into the calculator block are formed on watchglass 66 at positions corresponding to the upper surface of symbols or numerals 64 for indicating time. This arrangement allows the time to be read without difficulty and does not detract from the analog display function of the timepiece. The watch dial 60 is provided with the liquid crystal display cell 62 which serves as the display section for the calculator mode. A plurality of transparent electrically conductive films 68 which also serve as function input members are disposed on watchglass 66 at positions corresponding to function symbols that are provided on the watch dial 60. Each segment of film 69 is disposed down the side surface of watchglass 66 and is connected to the input key circuit 89, as shown in FIG. 7, by means of electrically conductive connectors 71 which can be seen in FIG. 6.

Arithmetic operations are performed by bringing any part of the body, such as a finger 90, into contact with the desired segment of the transparent electrically conductive film 69. The actual operation is accomplished by a high frequency signal that is applied to the calculation circuit 88 when a capacitance develops between the finger and the film. Inputs are written into the timepiece in a manner entirely similar to that employed when operating an ordinary calculator.

In accordance with the arrangement as described above, a switch is constructed by disposing a transparent electrically conductive film over numbers, characters or symbols provided on a watch dial, whereby it is possible to provide a calculator-equipped timepiece having the same size as an ordinary timepiece, and at the same time eliminate complicated mechanical switches and replace them with switches of an electrical type, an advantage which permits simplification of the timepiece case and enhancement of its water-proof property.

Figure 8:
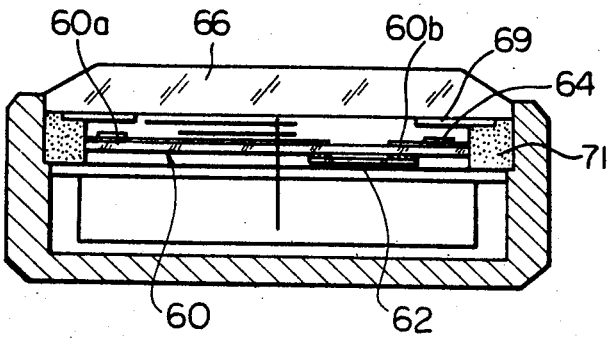
FIG. 8 is a cross section showing a modification of the structure shown in FIGS. 5 and 6.

FIG. 8 illustrates another embodiment of the present invention in which the transparent electrically conductive film 69 is disposed on the lower surface of watchglass 66. In this case efficiency can be further enhanced by using an electrically conductive probe or the like to write in the arithmetic inputs instead of making use of a finger.

Switching over between the timekeeping and calculator modes is accomplished by manipulating a control member 72 which is also used to perform time corrections. Time corrections may also be performed using the film 69 in the following manner. For example, the timepiece can be adapted such that touching numeral 2 on the dial advances the timepiece by 20 seconds.

Although the description of the present embodiments has been limited to the calculator function, it should be understood that a customary calendar display can be made to appear digitally when the calculator mode has not been selected, an external control member such as a crown being used to switch over between the calendar and calculator displays.

What is claimed is:

1. In an analog quartz crystal timepiece providing a multi-alarm function and having a watch case, and a watch movement adapted to drive time indicating hands and having a circuit board mounted thereon, the improvement comprising:

a time dial disposed in said watch case and including a plurality of circumferentially spaced time-indicating numerical indicia, and an access window;

an electro-optical digital display device mounted on a bottom surface of said time dial at said access window to provide a display of said multi-alarm function;

a plurality of display indicia indicative of said multi-alarm function and formed on said time dial at an area other than those in which said time-indicating numerical indicia are formed;

a watch glass plate secured to said watch case above said time dial;

a plurality of first transparent electrically conductive electrode films formed on said watch glass plate at positions corresponding to said plurality of circumferentially spaced time-indicating numerical indicia, respectively, to permit generation of input signals corresponding to said time-indicating numerical indicia, each of said plurality of transparent electrically conductive electrode films having a terminal portion formed on a bottom surface of said watch glass plate;

a plurality of second transparent electrically conductive electrode films formed on said glass plate at positions corresponding to said plurality of display indicia, respectively and serving as switches for inputting a plurality of alarm time data;

a transparent insulating film formed over said watch glass plate and said plurality of transparent electrically conductive electrode films; and a plurality of electrically conductive connectors disposed between said circuit board and the corresponding ones of said terminal portions of said plurality of electrically conductive electrode films.

2. In an analog quartz crystal timepiece equipped with an electronic calculation circuit to provide calculation data and having a watch case, a watch movement adapted to drive time indicating hands and having a circuit board mounted thereon, and an electro-optical display device to display said calculation data, the improvement comprising:

a time dial disposed in said watch case and including a plurality of circumferentially spaced time-indicating numerical indicia, a plurality of display indicia representing a plurality of function key symbols and formed on said time dial at an area other than those in which said time-indicating numerical indicia are formed, and an access window;

a watch glass plate secured to said watch case above said time dial;

a plurality of transparent electrically conductive electrode films formed on said watch glass plate at positions corresponding to said plurality of circumferentially spaced time-indicating numerical indicia and said display indicia, respectively, and serving as numeric and function key switches for said electronic calculation circuit to permit generation of input signals corresponding to said time-indicating numerical indicia and said display indicia, each of said plurality of transparent electrically conductive electrode films having a terminal portion formed on a bottom surface of said watch glass plate;

a transparent insulating film formed over said watch glass plate and said plurality of transparent electrically conductive electrode films; and a plurality of electrically conductive connectors disposed between said circuit board and the corresponding ones of said terminal portions of said plurality of electrically conductive electrode films;

said electro-optical display device mounted on a bottom surface of said time dial at said access window and including a transparent upper glass plate, a transparent lower glass plate, and a shield layer formed over said transparent upper glass plate constituting said dial plate and said plurality of numerical display indicia and said display indicia being formed over said shield layer.

* * * * *